United States Patent [19]

Bell et al.

[11] Patent Number: 4,951,094

[45] Date of Patent: Aug. 21, 1990

[54] DISPENSING CARTRIDGE FOR A ZEROGRAPHIC REPRODUCTION MACHINE

[75] Inventors: Conrad J. Bell, Webster; Pat Grasso; John Webb, both of Fairport, all of N.Y.

[73] Assignee: Xerox Corporation, Stamford, Conn.

[21] Appl. No.: 464,492

[22] Filed: Jan. 12, 1990

[51] Int. Cl.[5] ..... G03G 15/06

[52] U.S. Cl. ..... 355/245; 118/653; 222/DIG. 1; 355/260

[58] Field of Search ..... 355/245, 260; 222/DIG. 1, 325, 167, 169, 172; 118/653

[56] References Cited

U.S. PATENT DOCUMENTS

| | | | |
|---|---|---|---|
| 3,337,072 | 8/1967 | Del Vecchio et al. | 214/304 |
| 3,339,807 | 9/1967 | Eichorn | 222/171 |
| 4,089,601 | 5/1978 | Nauone | 355/14 |
| 4,688,926 | 8/1987 | Manno | 355/3 |

FOREIGN PATENT DOCUMENTS

| | | | |
|---|---|---|---|
| 3000386 | 7/1981 | Fed. Rep. of Germany | 118/653 |

*Primary Examiner*—A. T. Grimley
*Assistant Examiner*—Christopher Horgan

[57] ABSTRACT

A toner cartridge is modified so as to improve the dispensing of toner through discharge ports extending longitudinally along the cartridge. A flexible flap member is secured external to the cylinder and overlies the ports so as to prevent toner from exiting the ports except along the preferred dispense zone, e.g., from the 4 o'clock to the 8 o'clock position.

4 Claims, 4 Drawing Sheets

DISPENSING CARTRIDGE FOR A ZEROGRAPHIC REPRODUCTION MACHINEBACKGROUND AND PRIOR ART STATEMENT

The present invention generally relates to a xeropraphic reproduction machine and, more particularly, to a toner dispensing cartridge for such a machine.

In xerographic type reproduction machines, latent electrostatic images of a document being copied or printed are generated on a charged surface of a moving recording member, such as a drum or belt photoreceptor, through exposure of the document being copied or in accordance with an electronic image signal input. Following exposure, the latent electrostatic images on the recording member are developed at a developing station, which, in typical present day practice, comprises one or more magnetic brushes for bringing a developer, usually a mixture of carrier beads and toner, into developing relation with the recording member and the image thereon. Following this, the developed image is transferred at a transfer station to a copy substrate material such as a sheet of paper. After transfer, the copy substrate material is fixed, as by fusing, to provide a permanent plot or reproduction.

In the course of developing images as described above, the toner portion of the developer mixture is depleted and, to maintain the necessary proportion of toner to carrier, fresh toner must be added from time to time.

Various types of toner re-supply systems are known in the prior art, as for example, the canister or cartridge type disclosed in U.S. Pat. No. 3,337,072 (DelVecchio et al.). In Del Vecchio, a toner supply canister consisting of relatively rotatable inner and outer concentric tubes, each with a toner dispensing opening, are used. The supply of fresh toner is held in the inner tube, and by rotating the inner tube relative to the outer tube, the toner dispensing openings in each are brought in alignment. Another system is shown in U.S. Pat. No. 3,339,807 (Eichorn). There, the toner supply canister, once mounted, rotates to bring the toner dispensing holes opposite a series of openings in a stationary grid. Preparatory to this, a tear away strip, which seals the holes during shipment, is first removed. In another prior art system shown by U.S. Pat. No. 4,089,601 (Navone), a toner canister housing is installed in the machine following which the canister is turned to communicate the toner dispensing openings within a developer sump. In U.S. Pat. No. 4,688,926 (Manno), a rotatable toner supply cartridge has a row of toner discharge ports with a toner rejecting rod with flats opposite each port. The rod, or in another embodiment, a slide plate, is periodically rotated coincident with cartridge rotation to provide a dispensing of a controlled amount of toner into a developer housing beneath the dispenser.

A common requirement for a gravity feed type of toner dispensing system is that toner be deposited as close to the vertical, or six o'clock position, as possible. This is to ensure that the toner be deposited directly into the developer mixture located below the toner cartridge, generally in a sump type arrangement. If any toner exits the toner dispenser in an area outside of, for example, the 4 to 8 o'clock angular range, the toner is apt to settle onto the surface of the developer housing where it may become airborne and enter as a contaminant into other parts of the machine. This type of unwanted toner dispensing may occur, for example, by small amounts of toner which are on the edges of the dispensing ports not falling free of the cartridge until the cartridge rotates past the preferred disposal area. According to one aspect of the present invention, a flexible flap member is longitudinally positioned adjacent to, and extending, over the toner dispensing ports in the toner cartridge and is mounted so as to be generally tangentially attached to the exterior surface of the cartridge. More particularly, the invention is directed toward a toner cartridge comprising: a tube-like cylinder adapted to contain a supply of toner, said cylinder having a plurality of toner discharge ports therein for the discharge of toner from said cylinder, said toner discharge ports extending at least partially along the longitudinal surface of said cylinder, and a flexible flap member attached to the exterior of said cylinder and adjacent said discharge ports so as to overlie said ports.

DETAILED DESCRIPTION OF THE INVENTION

Figure 1:
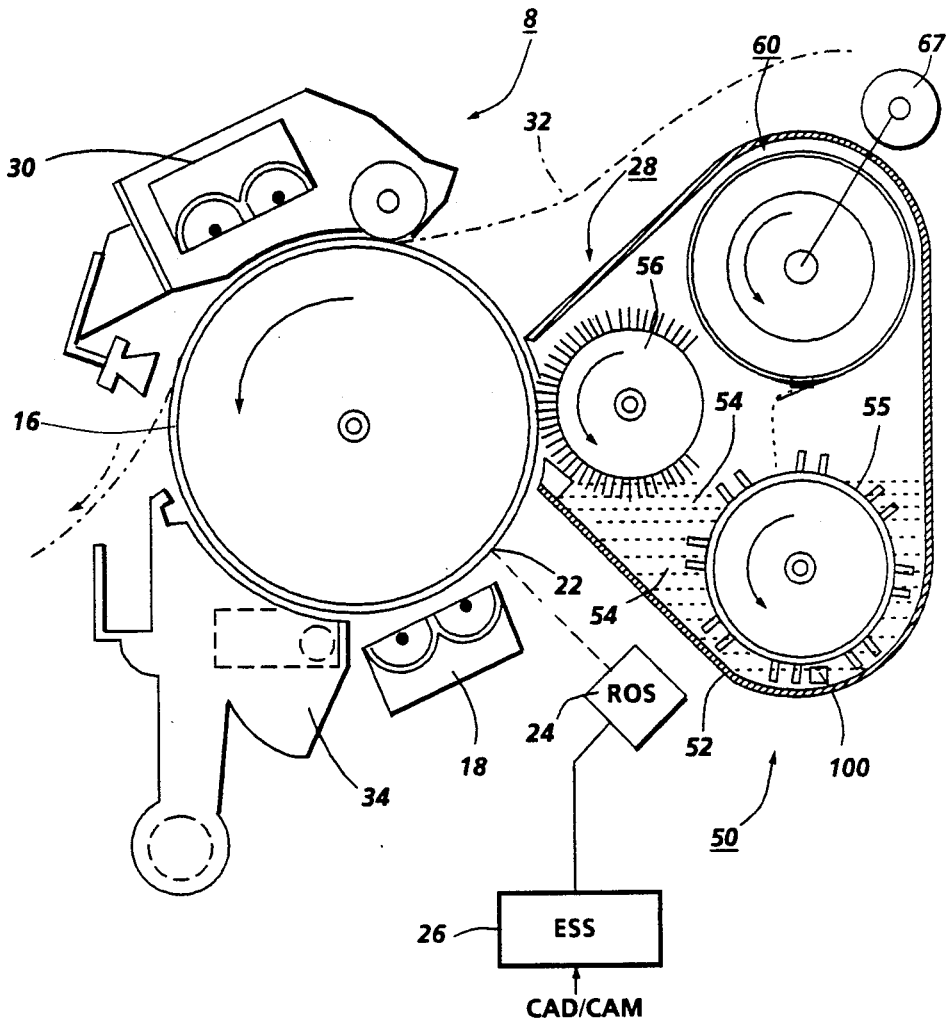
FIG. 1 is a side view of a reproduction machine having the toner cartridge of the present invention.

Referring to FIG. 1 of the drawings, there is shown a reproduction machine 8 incorporating the present invention. Machine 8, in the embodiment shown, is a xerographic laser printer plotter incorporating various optical and xeropraphic stations. The invention, however, can be used in other types of xerographic copiers. Briefly, as will be familiar to those skilled in the xerographic printing and copying arts, the xerographic components of the machine include a charge retentive recording member shown here in the form of a rotatable photoreceptor drum 16. In the exemplary arrangement shown, photoreceptor 16 comprises a drum having a photoconductive surface. Other photoreceptors such as a photosensitive belt or web may instead be used.

Operatively disposed about the periphery of photoreceptor drum 16 are charging station 18 for placing a uniform charge on the photoconductive surface of photoreceptor 16, an exposure station 22 where the previously charged photoconductive surface is exposed to a modulated light pattern. The surface is exposed to form a latent image by a raster output scanner (ROS) 24 whose output is a modulated light beam which "writes" upon the drum surface to form a latent image according to the input information regulating the ROS. In this embodiment, the input information originates in a CAD/CAM input which enters an electronic sub-system (ESS) 26. Electronic sub-system 26 takes the vector data and transforms the data into laser modulated data in the ROS.

Continuing with the system description, the latent electrostatic image created on the photoconductive surface is developed by toner at development station 28. The transfer portion of the combined transfer and detack station 30 provides for sequentially transferring the developed image to a suitable copy substrate material such as a copy sheet 32 brought forward in timed relation with the developed image on the drum surface. The detack operation lessens the forces of attraction between the copy sheet and the photoreceptor surface. Cleaning station 34 removes leftover developer from the photoconductive surface, and neutralizes residual charges thereon.

Copy sheet 32 is brought forward to transfer station 30 by a gripper bar system (not shown). Following tranfer, the sheet 32 is carried forward to a fusing station (not shown).

Figure 2:
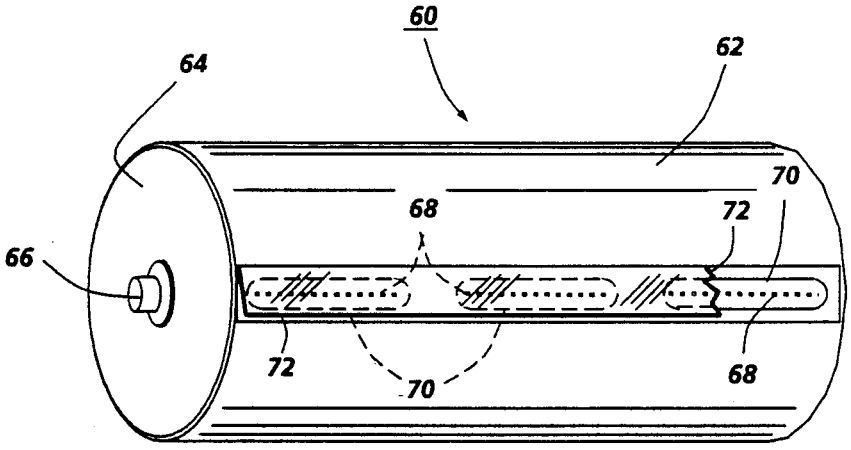
FIG. 2 is a front perspective view of the toner dispensing cartridge illustrating the location of the toner discharge directional flap.

Developer station 28 includes a developer housing 50 the lower part of which forms sump 52 for holding developer bed 54. Located in sump 52 is a paddle wheel mixer 55 which brings toner into contact with magnetic developer roll 56. Developer bed 54 contains a mixture of carrier particles and smaller toner particles. Magnetic developer roll 56 is rotatingly brought into developing relationship with the surface of photoreceptor 16 to develop the latent image previously formed at the exposure station. As toner is depleted during continued operation fresh toner must continually be added. This is accomplished by rotatable toner supply cartridge 60. As shown in FIG. 2, cartridge 60 is a hollow tube or cylinder 62, which may, for example, be formed from any relatively inexpensive light weight material such as cardboard. A supply of fresh toner is contained within the cylinder. Cylinder 62 is tightly sealed at both ends by end caps 64 to prevent the escape of leakage of toner. Tube 62 is supported at hub 66 for rotation by motor 67. A plurality of spaced, slot-like toner discharge openings or ports 68 are provided in the surface of cylinder 62, ports 68 being arranged in a linear row. The ports 68, all of equal diameter, are formed within elliptical areas 70 designed to provide a uniform toner dispersal therethrough. Port 68 diameters of about 0.8 mm and optimum cartridge rotation of 60 rpm results in toner being dispensed as a mist or fine spray. With the cartridge being rotated at 60 rpm during a dispense cycle, the toner is unbridged by the flopping action of the toner with the cartridge, an action which contributes to the efficiency of the toner dispenser.

Figure 3:
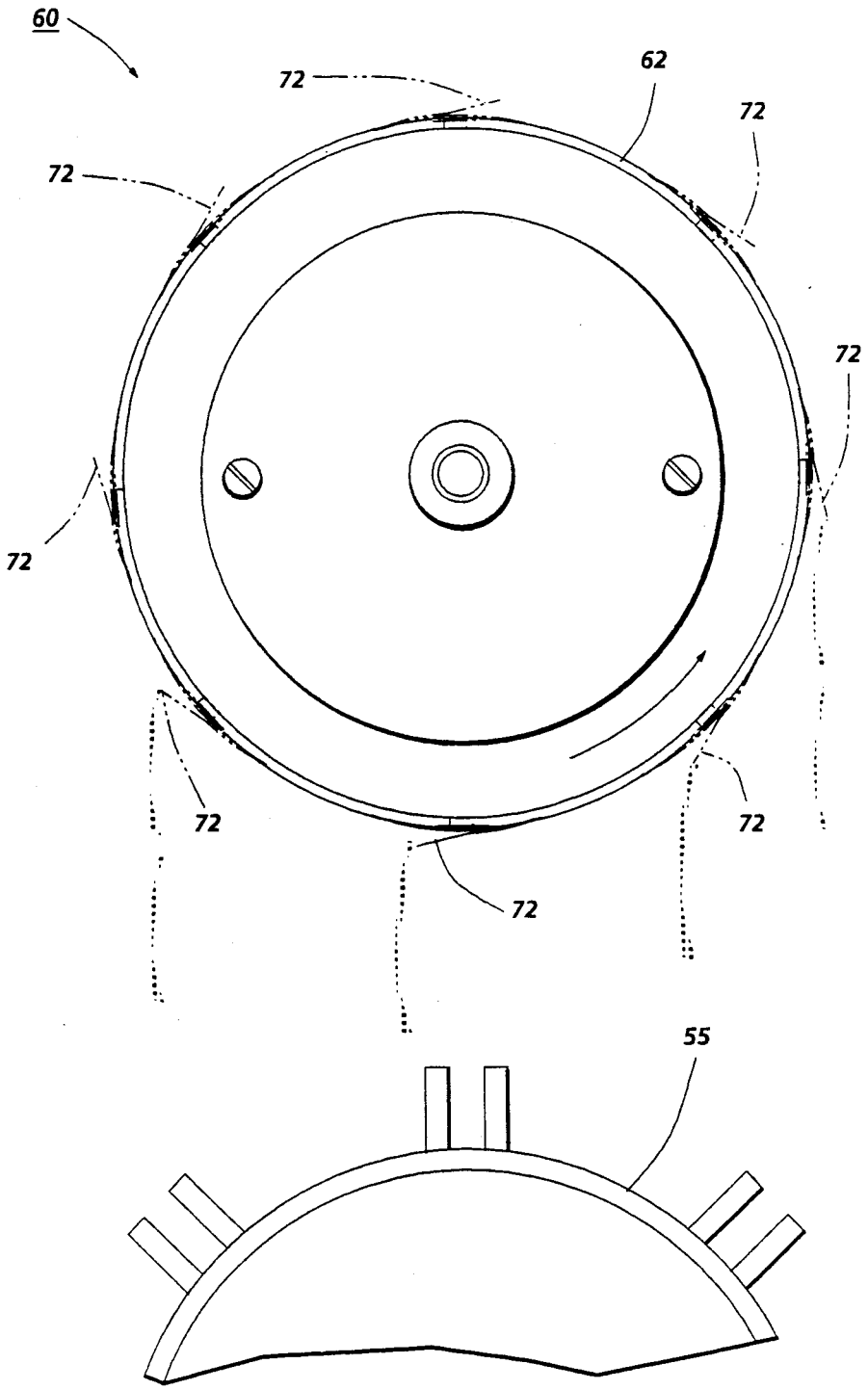
FIG. 3 shows the cartridge dispensing toner at three sequential dispense positions.

According to the principles of the invention, toner cartridge 60, has been modified by the addition of a flexible toner directional flap 72. Flap 72 is affixed to the surface of the cartridge at a point upstream of ports 68. The flap also extends longitudinally along the cartridge surface. About $\frac{1}{3}$ of the width of flap 72 is attached to the surface of cylinder 62 with the remaining $\frac{2}{3}$ of the width projecting outwards generally tangentially a sufficient distance to cover ports 68. However, there exists a small distance between flap 72 and the ports that widens towards the outer edge of the flap. The function of flap 72 is shown with the reference to FIG. 3 which shows the flap in solid line at the 6 o'clock or dump position. Other various positions the flap can assume during drag cartridge rotation are shown in dotted form. It is assumed that the area directly beneath the 8 o'clock to 4 o'clock position is occupied by the developer bed 54 and, therefore, it is desirable that any toner disposed through the ports 68 during a rotational cycle fall into this area. The position of the flap 72 ensures that any toner leakage outside the critical 8 to 4 o'clock zone is prevented from acquiring a horizontal component of motion since the toner will strike the flap surface and will either be directed downwardly (in the 12 o'clock to 4 o'clock position) or begin to accumulate in the space between flap 72 and the cylinder surface, the 8–12 o'clock position. (The area of this space can vary because of the flexible nature of the flap). Once the cartridge rotates into the dispensing zone, toner may begin to separate from the flap surface to fall downward into the developer bed. The toner drop rate increases and reaches a maximum at about 4 o'clock position when flap 72 assumes a vertical orientation, and all toner which may have accumulated on its surface is "dumped". It is thus apparent that flap 72 serves to concentrate toner dispensing so that is occurs only in a preferred area. In a preferred embodiment flap 72 is of a flexible material such as mylar or other similar material having the characteristics of flexibility combined with the ability to maintain its physical integrity with changes in environmental conditions. It is understood that the use of the toner directional flap member can be extended to other types of toner cartridges in addition to the one shown in FIGS. 1 and 2. Generally, any type of toner cartridge whether rotated constantly or oscillated within the dispensing zone can be improved by adding the flap of the present invention. The dispensing ports may assume other types of shapes and distribution patterns other than that shown. The invention is a particularly useful modification to the toner cartridge disclosed in U.S. Pat. No. 4,688,926, particularly the FIGS. 8 and 9 embodiment. The contents of this patent are hereby incorporated by reference.

Figure 4:
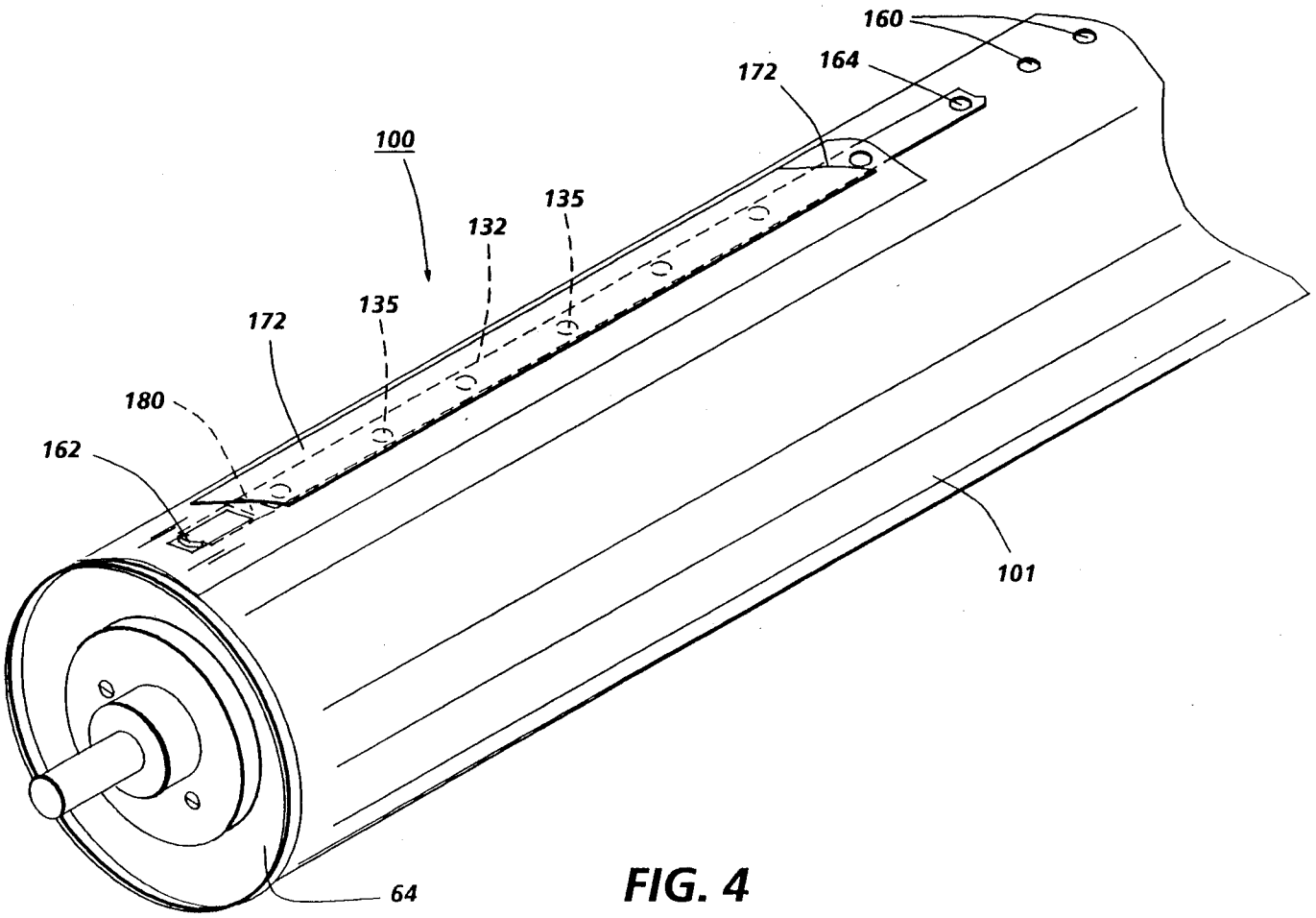
FIG. 4 is a front perspective view of a second embodiment of a toner cartridge utilizing the toner discharge directional flaps.

FIG. 4 of the present application shows a perspective view of the cartridge disclosed in FIG. 8 of U.S. Pat. No. 4,688,926 modified by addition of a flap member. Referring to FIG. 4, cylinder 101 of cartridge 100 has a row of generally circular toner discharge openings or ports 160. An elongated rigid strip-like slide plate 162 controls opening and closing of toner discharge ports 160, plate 162 being held in tight face to face contact with the outer surface of cylinder 101 opposite ports 160 by a tape 132 to seal cylinder 101 against the leakage or loss of toner when plate 162 is in the closed position. Plate 162, which is supported for reciprocating back and forth sliding movement along the outer surface of cylinder 101, has a series of toner discharge openings 164 therein which mate with ports 160 in cylinder 101 and openings 135 in tape 132 when slide plate 162 is moved to the open position. Toner discharge ports 160 and openings 164 and 135 in plate 162 and tape 132, respectively, are of substantially the same size and shape. The plastic toner directing flap member 172 is attached to tape 132 and extends generally tangentially outward from the surface of cylinder 101 to overlie ports 135. The cooperation of slide plate 162 with the underlying parts is disclosed in the '926 patent. Flap 172 functions in the same manner as described in connection with the FIGS. 1 and 2 embodiment of the present invention. As a further means of preventing toner from escaping at the ends of the slide plate 162 (e.g., toner that would be carried with the slide plate as it moves towards the end position of the cylinder) two sealant pads 180 are inserted at both ends, (only one shown) to prevent toner from passing beyond that point.

While the invention has been described in conjunction with a few specific embodiments, it is evident to those skilled in the art that many alternatives, modifications and variations will be apparent in light of the foregoing description. Accordingly, the invention is intended to embrace all such alternatives, modifications and variations as fall within the spirit and scope of the appended claims.

We claim:

1. A toner cartridge comprising:

a tube-like cylinder adapted to contain a supply of toner, said cylinder having a plurality of toner discharge ports therein for the discharge of toner from said cylinder, said toner discharge ports extending at least partially along the longitudinal surface of said cylinder, and a flexible flap member attached to the exterior of said cylinder and adjacent said discharge ports so as to overlie said ports.

2. The cartridge of claim 1 wherein said flap member is attached generally tangentially to the exterior surface of said cylinder.

3. In a copying/printing machine having a movable recording member on which latent electrostatic images are created, developing means for developing said images with toner, and transfer means for transferring the developed images to a copy substrate material, said developing means including a developer housing adjacent said recording member with means in said housing to bring developer from said housing into developing relation with said recording member to develop images on said recording member, the combination of:

a tube-like cylinder adapted to contain a supply of fresh toner;

means supporting said cylinder in spaced relation above a sump;

drive means for rotating said cylinder;

said cylinder having a plurality of toner discharge opening therein for toner to pass from said cylinder into said developer housing, said toner discharge openings comprising a row of openings extending along the longitudinal axis of said cylinder; and a flexible flap member attached generally tangentially to the exterior of said cylinder and overlying said toner discharge opening.

4. The machine of claim 3 further including:

a longitudinally extending plate on the periphery of said cylinder opposite said toner discharge ports; and means supporting said plate for reciprocating sliding movement on said cylinder;

said plate having toner discharge openings therein cooperable with said toner discharge ports in said cylinder to control discharge of toner from said cylinder through said toner discharge ports, movement of said plate to one position bringing said toner discharge openings in said plate into communicating relation with said toner discharge ports in said cylinder so that toner can discharge from said cylinder through said toner discharge ports in said cylinder, said plate when moved to a different position interrupting communications between said toner discharge ports in said cylinder and said toner discharge opening in said plate, and sealing pads at each end of said plate to prevent toner from escaping at the ends.

* * * * *